US007012416B2

(12) United States Patent
Marinca

(10) Patent No.: US 7,012,416 B2
(45) Date of Patent: Mar. 14, 2006

(54) BANDGAP VOLTAGE REFERENCE

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 10/731,704

(22) Filed: Dec. 9, 2003

(65) Prior Publication Data

US 2005/0122091 A1 Jun. 9, 2005

(51) Int. Cl.
*G05F 3/16* (2006.01)

(52) U.S. Cl. ..... 323/316; 323/313; 327/490

(58) Field of Classification Search ..... 323/312–316; 327/490, 539, 542

See application file for complete search history.

(56) References Cited

U.S. PATENT DOCUMENTS

| | | | | |
|---|---|---|---|---|
| 3,914,684 | A | 10/1975 | Leidich | |
| 4,399,398 | A | 8/1983 | Wittlinger | |
| 4,399,399 | A * | 8/1983 | Joseph | 323/315 |
| 4,603,291 | A | 7/1986 | Nelson | |
| 4,808,908 | A | 2/1989 | Lewis et al. | |
| 4,939,442 | A | 7/1990 | Carvajal et al. | |
| 5,053,640 | A | 10/1991 | Yum | |
| 5,325,045 | A | 6/1994 | Sundby | |
| 5,352,973 | A | 10/1994 | Audy | |
| 5,424,628 | A | 6/1995 | Nguyen | |
| 5,512,817 | A | 4/1996 | Nagaraj | |
| 5,751,142 | A * | 5/1998 | Dosho et al. | 323/316 |
| 5,789,906 | A * | 8/1998 | Mizuide | 323/313 |
| 6,157,245 | A | 12/2000 | Rincon-Mora | |
| 6,218,822 | B1 | 4/2001 | MacQuigg | |
| 6,411,158 | B1 * | 6/2002 | Essig | 327/539 |
| 6,590,372 | B1 * | 7/2003 | Wiles, Jr. | 323/316 |
| 6,614,284 | B1 * | 9/2003 | Beeman et al. | 327/334 |
| 6,677,808 | B1 * | 1/2004 | Sean et al. | 327/539 |

* cited by examiner

*Primary Examiner*—Gary L. Laxton
(74) *Attorney, Agent, or Firm*—Wolf, Greenfield & Sacks, P.C.

(57) ABSTRACT

A bandgap voltage reference is described which has reduced sensitivity to noise and amplifier offset. By configuring the circuitry such that the base width of the component transistors is not varied on application of a bias, it is possible to obviate the Early effect.

19 Claims, 8 Drawing Sheets

BANDGAP VOLTAGE REFERENCE

FIELD OF THE INVENTION

The present invention relates to voltage reference circuits and in particular to a voltage reference circuit implemented using bandgap techniques. More particularly the present invention relates to a method and circuit that provide a voltage reference with very low temperature coefficient (TC) and reduced sensitivity to amplifier noise and offset.

BACKGROUND OF THE INVENTION

A bandgap voltage reference circuit is based on addition of two voltages having equal and opposite temperature coefficient. The first voltage is a base-emitter voltage of a forward-biased bipolar transistor. This voltage has a negative TC of about −2.2 mV/° C. and is usually denoted as a Complementary to Absolute Temperature or CTAT voltage. The second voltage which is Proportional to Absolute Temperature, or a PTAT voltage, is formed by amplifying the voltage difference (ΔVbe) of two forward biased base emitter junctions of bipolar transistors operating at different current densities. These type of circuits are well known and further details of their operation is given in Chapter 4 of *Analysis and Design of Analog Integrated Circuits,* $4^{th}$ Edition by Gray et al, the contents of which are incorporated herein by reference.

A classical configuration of such a voltage reference circuit is known as a "Brokaw Cell", an example of which is shown in FIG. 1. First and second transistors Q1, Q2 have their respective collectors coupled to the non-inverting and inverting inputs of an amplifier A1. The bases of the transistors are commonly coupled, and this common node is coupled via a resistor, r5, to the output of the amplifier. This common node of the coupled bases and resistor r5 is coupled via another resistor, r6, to ground. The emitter of Q2 is coupled via a resistor, r1, to a common node with the emitter of transistor Q1. This common node is then coupled via a second resistor, r2, to ground. A feedback loop from the output node of A1 is provided via a resistor, r3, to the collector of Q2, and via a resistor r4 to the collector of Q1.

In FIG. 1, the transistor Q2 is provided with a larger emitter area relative to that of transistor Q1 and as such, the two bipolar transistors Q1 and Q2 operate at different current densities. Across resistor r1 a voltage, ΔVbe, is developed of the form:

$$\Delta Vbe = \frac{KT}{q}\ln(n) \tag{1}$$

where k is the Boltzmann constant, q is the charge on the electron,

T is the operating temperature in Kelvin, n is the collector current density ratio of the two bipolar transistors.

Usually the two resistors r3 and r4 are equal and the collector current density ratio is given by the ratio of emitter area of Q2 to that of Q1. In order to reduce the reference voltage variation due to the process variation, Q2 may be provided as an array of n transistors, each transistor being of the same area as Q1.

The voltage ΔVbe generates a current, I1, which is also a PTAT current.

The voltage of the common base node of Q1 and Q2 will be:

$$V_b = 2\Delta Vbe * \frac{r2}{r1} + V_{be1} \tag{2}$$

By properly scaling the resistor's ratio and current density the voltage $V_b$" is temperature insensitive by the first order, and apart from the curvature which is effected by the base-emitter voltage can be considered as remaining compensated. The voltage $V_b$ is scaled to the amplifier's output as a reference voltage, $V_{ref}$, by the ratio of r5 to r6:

$$V_{ref} = \left(2\Delta V_{be} * \frac{r_2}{r_1} + V_{be1}\right)\left(1 + \frac{r_5}{r_6}\right) + (I_b(Q_1) + I_b(Q_2))r_5 \tag{3}$$

Here, $I_b(Q_1)$ and $I_b(Q_2)$ are the base currents of transistors Q1 and Q2.

Although a "Brokaw Cell" is widely used, it still has some drawbacks. The second term in equation 3 represents the error due to the base currents. In order to reduce this error r5 has to be as low as possible. As r5 is reduced, the current extracted from supply voltage via reference voltage increases and this is a drawback. Another drawback is related to the fact that as operating temperature changes the collector-base voltage of the two transistors also changes. As a result of the Early effect (the effect on transistor operation of varying the effective base width due to the application of bias), the currents into the two transistors are affected. Further information on the Early effect may be found on page 15 of the aforementioned $4^{th}$ Edition of *Analysis and Design of Analog Integrated Circuits.*

If the second order effects in the circuit of FIG. 1 are neglected, the amplifier's input offset voltage $V_{off}$ is reflected into the reference voltage node as:

$$V_{ref-off} = V_{off} * \frac{r2}{r4}\left(1 + \frac{r5}{r6}\right) \tag{4}$$

The amplifier's noise is also reflected from input to reference node with the same gain:

$$G = \frac{r2}{r4}\left(1 + \frac{r5}{r6}\right) \tag{5}$$

From equation 4 and FIG. 1 it is clear that the easy way to reduce offset and noise sensitivity in a "Brokaw Cell" is to make r4 larger compared to r2. But as r4 is larger, the collector-base voltages of Q1 and Q2 are also larger and Early effect is exaggerated.

The "Brokaw Cell" also suffers, in the same way as all uncompensated reference voltages do, in that it is affected by "curvature" of base-emitter voltage.

The base-emitter voltage of a bipolar transistor, used as a CTAT voltage in bandgap voltage references, and as biased by a PTAT collector current is temperature related as equation 6 shows:

$$V_{be}(T) = V_{G0}\left(1 - \frac{T}{T_0}\right) + V_{be0}\frac{T}{T_0} - (\sigma - 1)\frac{kT}{q}\ln\left(\frac{T}{T_0}\right) \quad (6)$$

where:

$V_{be}(T)$ is the temperature dependence of the base-emitter voltage for the bipolar transistor at operating temperature, $V_{BE0}$ is the base-emitter voltage for the bipolar transistor at a reference temperature, $V_{G0}$ is the bandgap voltage or base-emitter voltage at 0 K temperature, $T_0$ is the reference temperature, σ is the saturation current temperature exponent (sometimes referred as XTI in computer-aided simulators).

The PTAT voltage developed across r2 in FIG. 1 only compensates for the first two terms in equation 6. The last term, which provides the "curvature" of the order of about 2.5 mV for the industrial temperature range (−40° C. to 85° C.) remains uncompensated and this is gained into the reference voltage by the gain factor G (equation 5).

As the "Brokaw Cell" is well balanced, it is not easy to compensate internally for the "curvature" error. One attempt to compensate for this error is presented in U.S. Pat. No. 5,352,973, co-assigned to the assignee of the present invention, the disclosure of which is incorporated herein by reference. In this US patent, although the "curvature" error is compensated, in this methodology by use of a separate circuit which biases an extra bipolar transistor with constant current, it does require the use of an additional circuit.

Other known examples of band gap reference circuits include those described in U.S. Pat. No. 4,399,398 assigned to the RCA Corporation which describes a voltage reference circuit with feedback which is adapted to control the current flowing between first and second output terminals in response to the reference potential departing from a predetermined value. This circuit is a simple implementation that achieves a reduction of the Early effect. The circuit serves to reduce the base current effect, but at the cost of high power. As a result, this circuit is only suited for relatively high current applications. This can be traced to the fact that the compensation for the base current is effected by operating transistor T1 at a higher current than transistor T2, and as the power is increased the dissipation across RS is also increased. Also, it will be appreciated from an examination of the circuitry that the power supply rejection achieved is relatively modest.

It will be appreciated therefore that although the circuitry described in FIG. 1 has very low offset and noise sensitivity, there is still a need to provide for further reduction in sensitivity to offset and noise.

SUMMARY OF THE INVENTION

Accordingly, a first embodiment of the invention provides an improved voltage reference circuit adapted to overcome these and other disadvantages of the prior art. The invention provides a bandgap reference circuit which by scaling the voltage difference between two transistors operating at different current densities can provide at an output of an amplifier a voltage reference. The circuit of the present invention is further adapted to reduce voltage differences between the collector-bases regions of the two transistors thereby minimising the Early effect.

In accordance with a preferred embodiment, a bandgap reference voltage circuit including a first amplifier having a first and second input and providing a voltage reference at the output thereof is provided. The amplifier is coupled at its first input to a first transistor and at the second input to a second transistor, the second transistor having an emitter area larger than that of the first transistor. The second transistor is coupled at its emitter to a load resistor, the load resistor providing, in use, a measure of the difference in base emitter voltages between the first and second transistors, ΔVbe, for use in the formation of the bandgap reference voltage. In accordance with the invention, the bases of each transistor are commonly coupled such that the base of the first and second transistor is at the same potential, one of the first and second transistors is provided in a diode connected configuration, and the base collector voltage of the other of the first and second transistors is maintained at zero by the amplifier which is coupled in a feedback loop to the collector of each of the transistors, thereby reducing the Early effect.

The circuit desirably further includes a third and fourth transistor, the third transistor being coupled to the emitter of the first transistor and the fourth transistor being coupled via the load resistor to the emitter of the second transistor, the emitter area of the fourth transistor being greater than that of the first or third transistor, such that the first and third transistors operate at a higher current density than the second and fourth transistors and wherein a PTAT voltage is provided via a resistor, in the feedback loop, at the second input to the amplifier such that the voltage provided at the output of the amplifier is a combination of the base emitter voltages of the first and third transistors plus the PTAT voltage.

Each of the third and fourth transistors are desirably provided in a diode connected configuration. The emitter of the third transistor is preferably coupled via a second resistor to ground, the value of the resistor effecting a shifting of the reference voltage from twice the natural bandgap voltage to a desired voltage, thereby enabling an offset adjustment to the circuit.

A third and fourth resistor are typically provided in each of the feedback loop paths between the output of the amplifier and the collectors of the first and second transistors respectively.

The resistors provided in each of the feedback loops are either substantially the same value, or may be chosen to be of different values.

The circuit may additionally include circuitry adapted to provide the base current for the non-diode connected transistor and to extract that same current from the collector of the same transistor, thereby maintaining the collector current of each of the first and second transistors at the same value.

Such circuitry may be adapted to compensate for base current variation between the non-diode connected transistor and the other transistor, thereby reducing errors in the circuit due to the base current.

Typically, the non-diode connected transistor is the first transistor and the circuitry adapted to extract the current from the collector of the first transistor includes a replication of the leg of the circuit defined by the first and third transistors, the replicated leg including a fifth and sixth transistor of the circuit, the base of the fifth transistor being coupled to the collector of the first transistor, the emitter of the fifth transistor being coupled to the collector of the sixth transistor, the base of the sixth transistor being coupled to the diode connected base of the third transistor thereby providing a current mirror, such that a base current is extracted from the collector of the first transistor by the fifth transistor.

The base currents of the first and second transistors may be further mirrored via seventh and eight transistors and a bipolar mirror, the base currents of the sixth and eight transistors being supplied by a double current mirror from the output of the amplifier such that the collector currents of each of the third, sixth and eight transistors are the same.

The collector of the fifth transistor is typically coupled via a resistor to the output of the amplifier, the value of the resistor being substantially equivalent to that of the fourth resistor such that the base current of the fifth transistor tracks the base current of the first transistor.

The base current of the first and second transistors may be further mirrored via a series of mirrors coupled to the fifth and seventh transistors such that the mirrored current may be extracted from the emitters of the fifth and seventh transistors thereby ensuring that the collector currents of the fifth and seventh transistors are substantially the same value, this current being further mirrored via a current mirror coupled between the collector of the seventh transistor and the output of the amplifier, thereby providing a PTAT current.

Certain embodiments may further include circuitry adapted to provide a correction voltage adapted to compensate for the curvature of the voltage of the first and third transistors, the incorporation of the correction voltage effecting a cancelling of the curvature.

Such circuitry is typically adapted to provide a mixture of PTAT and CTAT voltages at the load resistor.

The correction voltage is typically provided by mirroring the base-emitter voltage of the fourth transistor across a resistor and effecting the generation of a complimentary to absolute temperature (CTAT) current using a MOSFET device and amplifier, the CTAT current being provided back into the fourth transistor via at least one current mirror thereby replicating across the load resistor a voltage having an inverse curvature, the combination of this replicated voltage and the previously present voltage ($\Delta V_{be}$) effecting a cancellation of the curvature.

The size of the voltage having an inverse curvature may be modified by changing the slope of the current provided by the current mirror and fourth transistor.

Modifications to the circuit of the invention may include a plurality of additional transistors coupled to the third and fourth transistors, the plurality of additional transistors being provided in a stack arrangement, thereby enabling a use of the reference circuit with higher reference voltages.

The invention also provides a method of providing a bandgap reference voltage circuit adapted to compensate for the Early effect, the method comprising the steps of:

providing first and second transistors, each transistor adapted to operate at different current densities, the first transistor being provided in a diode connected configuration, the transistors being additionally coupled to the inputs of an amplifier, scaling the voltage difference between two transistors operating at different current densities so as to provide a reference voltage at an output of the amplifier, providing a feedback loop, the feedback loop coupling each of the first and second transistors to the output of the amplifier so as to provide at an output of an amplifier a voltage reference, such that the collector base voltage of each of the first and second transistors is reduced to zero.

BRIEF DESCRIPTION OF THE DRAWINGS

The present invention will now be described with reference to the accompanying drawings in which.

DETAILED DESCRIPTION OF THE DRAWINGS

The prior art has been described with reference to FIG. 1.

Figure 2:
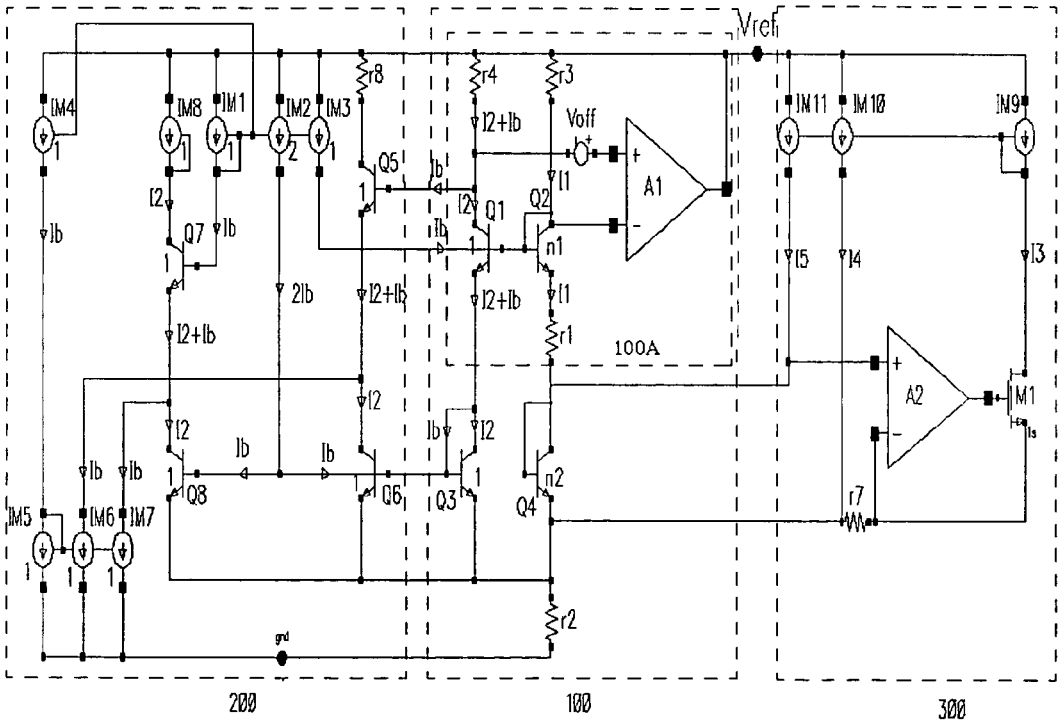
FIG. 2 is an example of a circuit according to a preferred embodiment of the present invention.

FIG. 2 is an example of a bandgap voltage reference in accordance with the present invention. The circuit of FIG. 2 may be sub-divided into three blocks: a main reference block 100; a bias current compensation block 200, and a curvature correction block 300, each block adapted to obviate specific problems associated with the prior art. As was detailed in the section "background to the invention" there are a number of problems associated with the prior art implementations of the classic Brokaw cell. These can be summarized as problems due to the Early effect, sensitivity due to base current, sensitivity due to offsets, power requirements arising from the coupling of the output from the voltage reference output across one or more resistors and the fact that there is no possibility to internally correct for curvature. The configuration shown in FIG. 2 is adapted to overcome these and other problems and the solution to each of the problems can be traced to specific components or functionality within the circuit.

As can be seen from FIG. 2, this circuit is based on generating a voltage reference using bandgap techniques. As is known, by using the scaled difference between two transistors operating at different current densities it is possible to combine these at an amplifier and provide a voltage reference at that amplifier output. In accordance with the circuit of the present invention, the main block 100 includes an amplifier A1 which has an inverting and non-inverting input. A first transistor Q1 is provided with a first emitter area and a second transistor Q2 is provided with a second emitter area, n1 times that of Q1. Q2 is provided in a diode connected configuration such that the collector is tied to the base. In accordance with standard operation, the amplifier A1 keeps its two inputs at substantially the same voltage level and as a result Q1 also operates at zero base-collector voltage. The bases of both Q1 and Q2 are coupled at the same potential, in a similar fashion to that described in FIG. 1. However, in accordance with the present invention the output of the amplifier is provided in a feedback configuration to the common base of Q1 and Q2 and to the collectors of Q1 and Q2. Desirably this feedback is provided such that the collector of Q2 is coupled via a resistor r3 and the collector of Q1 via a resistor r4. It can be seen that Q1 and Q2 have zero collector-base voltages, Q1 being a diode connected transistor and Q2 has also zero collector-base voltage due to the amplifier A1 and therefore the "Early" effect is eliminated. This set of circuitry is shown within the dashed block 100A of FIG. 2. It will be appreciated that although the arrangement within block 100A illustrates the base-collector voltage of Q1 being controlled by the amplifier and that of the Q2 by virtue of the diode connection arrangement, that equivalently Q1 may be diode connected and Q2 controlled by the amplifier. It will be further appreciated that, if the base current can be neglected, such as in the case of applications having high β, that no additional circuitry is required to compensate for the base current.

The emitters of each of transistors Q1 and Q2 are typically coupled to the collectors of two further transistors Q3 and Q4 respectively, also diode connected. In the case of Q1, this is a direct connection whereas with Q2 it is via a resistor r1. Q3 is provided with the same emitter area as Q1 and Q4 has an emitter area of "n2" times larger that of Q1 and Q3. Q1 and Q3 therefore operate at a higher current density as compared to Q2 and Q4 and across r1, a ΔVbe voltage, which is a PTAT voltage, is developed. This results in a PTAT current flowing from the amplifier's output through Q1 to Q3 and Q2 to Q4 via r1. The common emitter of Q3 and Q6 are connected to the ground node via a resistor r2. This resistor has a role of shifting the reference voltage from twice the natural bandgap voltage (~2.3V), for r2=0, to a desired value, for example a typical 2.5V.

The bias current compensation block, 200, has the role of supplying the base current for Q1, Ib, and for extracting the same current from its collector. If this is the case, the currents passing r1 and r3 are substantially the same and they are not affected by the base currents. The current passing r4 is the same current as the emitter current of Q1. As a result the voltage drop over r3 and r4 is a scaled replica of ΔVbe voltage. The circuitry of this block is useful in applications having low or moderate β, where the contribution of the base current may introduce errors, and is specifically provided to reduce these errors. It will be appreciated that although r1 and r3 are typically chosen to have the same values, that they could for certain applications be specifically chosen to have different values. The advantage of using the bias current compensation block is that the base currents will be compensated by the subtraction and subsequent re-introduction of a base current into the main block 100, regardless of the value of the chosen r1 and r3.

The base current Ib is extracted from collector of Q1 by mirroring the current I2 via Q5 and Q6. These transistors form an equivalent leg to that provided by Q1 and Q3. As Q3 in the block 100 and Q6 in the block 200 have the same base-emitter voltage, their collector currents will be substantially the same, I2. The base current, Ib, is also mirrored via Q8, Q7 and a typical bipolar mirror IM1, usually a bipolar pnp diode connected transistor. The base currents of Q8 and Q6 (2 Ib) are supplied back via a double current mirror IM2. In this way Q3, Q6 and Q8 will have exactly the same collector currents as they operate at the same base current. In order to minimise the base current difference from Q1 to Q5 an extra resistor r8 is provided, with substantially the same value as r4, thereby ensuring that Q1 and Q5 operate in similar conditions, having the same collector current and substantially zero base-collector voltage. As a result the base current of Q5 will track the base current of Q1. Due to the similarities between the two legs provided by Q1/Q3 and Q5/Q6, the tracking performance of the base current achieved is very accurate.

The base current, Ib, is also mirrored from the current mirror IM4 to a "master" mirror IM5, usually a bipolar npn diode connected transistor. This current is extracted via mirrors IM5 and IM7 from the emitters of Q5 and Q7 to ensure that the collector currents of Q5 and Q7 are substantially the same current as the collector of Q3, which is I2. The PTAT current I2 is mirrored via a "master" mirror IM8 connected between the reference voltage and the collector of Q7. In this way the cell according to FIG. 2 can also generate a PTAT current.

It will be further appreciated from an examination of the components of the circuitry of the block 200, that one set of circuitry is used to pull the base current and another set of circuitry is used to generate and provide the base current back into block 100. By using two different sets of circuit components it is possible to more accurately extract the base current. This is because this extraction circuitry has no additional functionality, specifically that associated with the generation of the base current to be re-introduced. The second set of circuitry has the specific purpose of re-provide that base current. The first set of components, that extracting the base current, is provided by the replicated leg, that leg having Q5 and Q6. The other components generate a base current that may be fed back to the coupled bases of Q1 and Q2.

Although the extraction and re-introduction of the base current to the block 100 could be achieved using a simpler configuration wherein the circuitry used to extract the base current from the collector of Q1 had the additional functionality of re-providing that base current to the base of Q1 and Q2, such circuitry would not achieve the accuracy of extraction that is possible using the arrangement described above.

The second order effect, or "curvature" of a typical bandgap voltage is compensated via the block 300. The circuitry of the block 300 is adapted to develop a negative "curvature" voltage in a manner similar to that described in co-pending and co-assigned U.S. Ser. No. 10/375,593 filed on 27 Feb. 2003, the content of which is incorporated herein by way of reference. The "curvature" correction is performed by mirroring the base-emitter voltage of Q4 across a resistor, r7, and by generating a CTAT current via MOSFET device M1, and current mirrors IM9 and IM11. The CTAT current is fed back into the diode-connected transistor Q4 in order to exaggerate its curvature and thereby replicating across r1 a negative voltage "curvature". This negative voltage "curvature" depends by the slope of the collector current of Q4, and is gained by the ratio r3/r1 to compensate for the positive voltage "curvature" of Q3 and Q1.

The current passing r2 is a combination of PTAT currents, flowing from Q3, Q4, Q6, Q8, and CTAT currents flowing from r7 and IM11. An extra CTAT current, I4, generated from a current mirror IM10 ensures that the voltage drop over r2 is the required shifting voltage and the reference voltage is the desired compensated reference voltage. It will be understood that the slope of the CTAT current generated can be varied by choice of current mirror IM11 and transistor Q4. The CTAT current and the PTAT current already across the load resistor r1 are then gained by the choice of the ratio of the load resistor r1 to the feedback resistor r3.

If we consider that the emitter areas of Q2 and Q4 are identical then n1=n2=n and r3=r4, then the PTAT voltage, ΔVbe, is:

$$\Delta V_{be} = 2\frac{KT}{q}\ln(n) \tag{7}$$

The reference voltage $V_{ref}$ is:

$$V_{ref} = V_{shift} + V_{be,Q3} + V_{be,Q1} + I_1 * r_3 \tag{8}$$

$$= V_{shift} + 2\left(V_{be1} + \Delta V_{be}\frac{r_3}{r_1}\right)$$

where $V_{shift}$ is a combination of PTAT and CTAT voltages:

$$V_{shift}=(4I_1+I_3+I_4+I_5)r_2 \tag{9}$$

Here $V_{be1}$ is the base-emitter voltage of Q1 and Q3.

In order to see the amplifier's offset voltage influence into the reference voltage let us consider that the base currents are neglected, r3=r4, n1=n2=n, and the amplifier A has a input offset voltage Voff as FIG. 2 shows. If the offset voltage is zero the two currents, I1 and I2, are balanced.

For a given offset voltage, $V_{off}$, the currents become unbalanced as equation 10 shows:

$$I_1r_3=I_2r_3+V_{off} \tag{10}$$

As equation 10 shows, for a positive offset voltage $I_1>I_2$. As the current $I_2$ into the high current density side (Q1, Q3) decreases and the current $I_1$ into the low current density side (Q2, Q4) increases $\Delta V_{be}$ decreases. This tends to decrease the current I1 and this inherent negative feedback play the role of rebalance the voltage drop over r3 which is the main PTAT voltage. For a negative offset voltage $I_1<I_2$, $\Delta V_{be}$ increases and PTAT voltage decreases.

Figure 1:
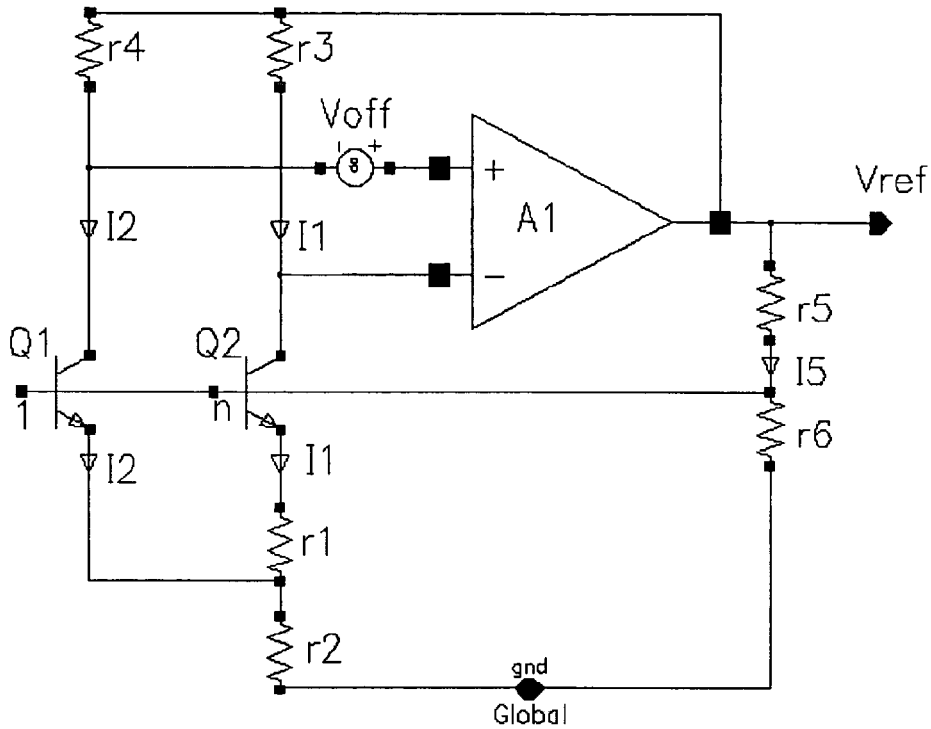
Fig.1. Prior Art
FIG. 1 is an example of a typical "Brokaw" cell in accordance with the prior art.

In order to see the improvements from the circuit according to FIG. 1 to the circuit according to FIG. 2, two appropriate circuits were simulated.

Figure 3:
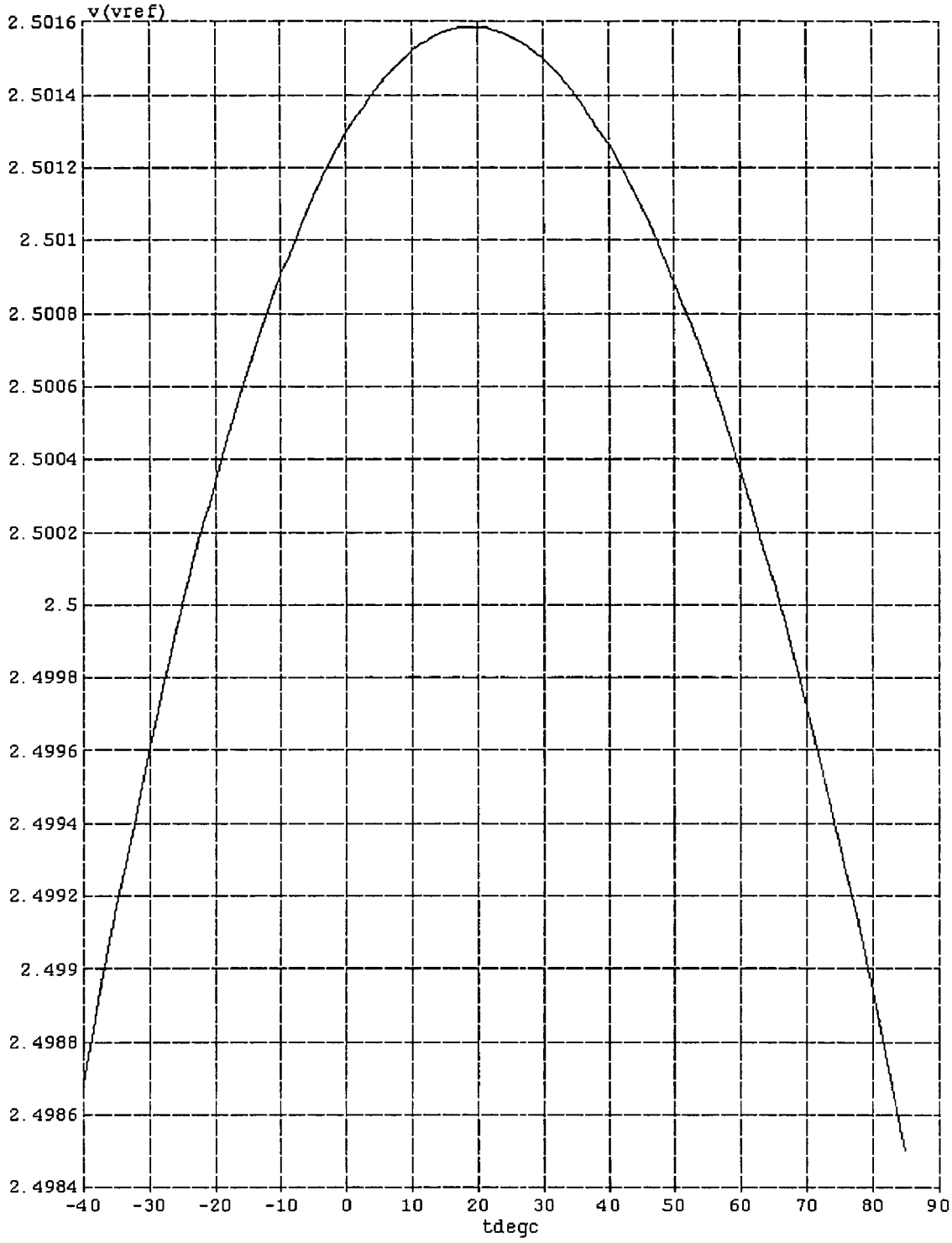
FIG. 3 is a simulation of the performance of a circuit in accordance with the prior art.

Into the simulated circuit according to FIG. 1 the resistors values are: r1=20 k; r2=56.5 k; r3=r4=100 k; r5=10.1 k; r5=10 k. Q1 is a unity 5×5 microns emitter transistor. Q2 is an area of 50 unity transistors of the same emitter area. The collector currents I1 and I2 are PTAT currents of about 5 uA at room temperature. The simulated reference voltage is presented in FIG. 3. The reference voltage variation is about 3 mV for the temperature range from −40° C. to 85° C. This corresponds to a TC of about 10 ppm/° C.

Figure 4:
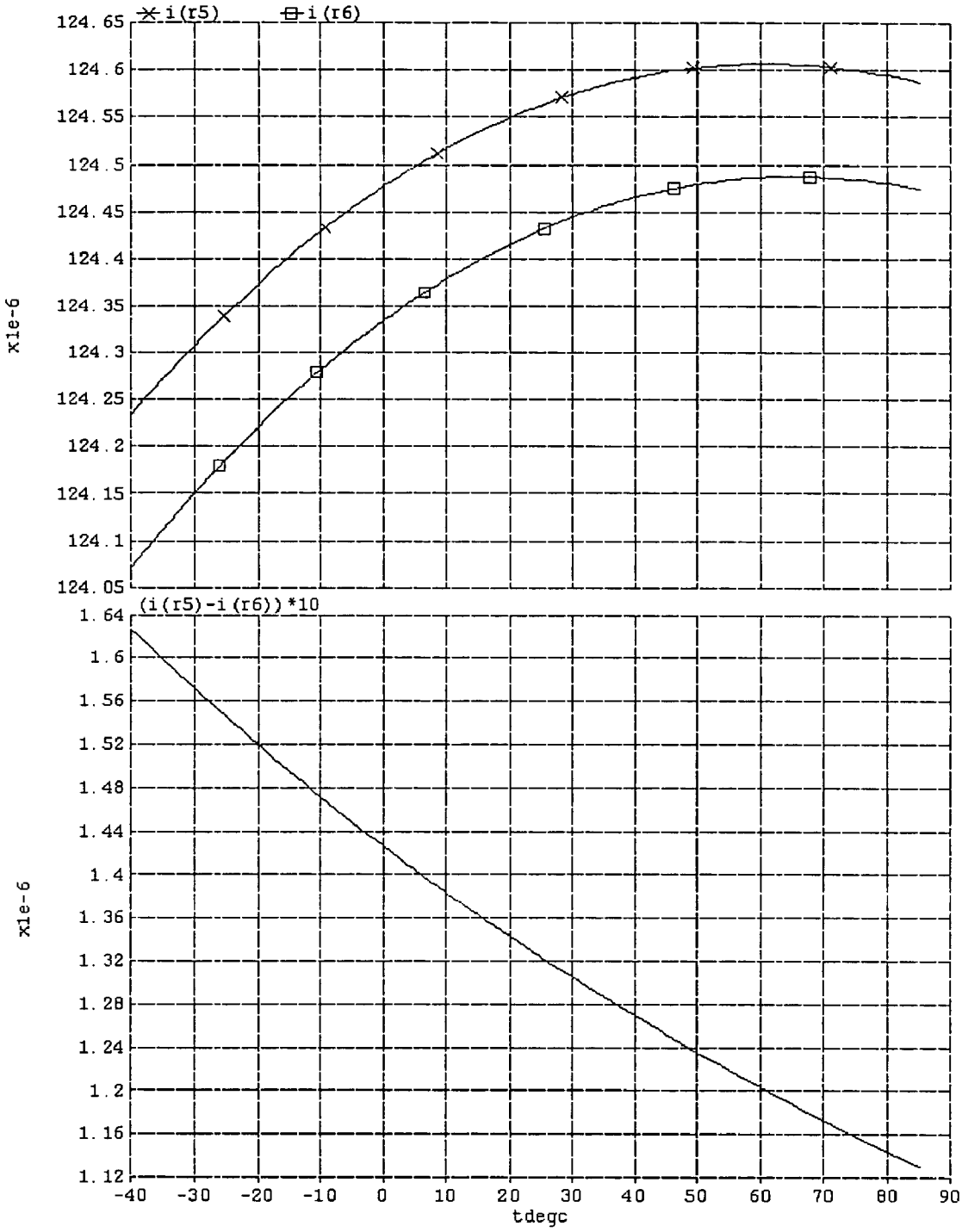
FIG. 4 is a simulation of the currents through the output divider (r5, r6) and their difference (base currents) for the circuit of FIG. 1.

FIG. 4 shows the currents through the gain resistors (r5, r6) and their difference, being the sum of two base currents. The current difference can be considered as an error because the factor "beta", or the ratio of the collector current to the base current has a large spread due to the process variation. As is seen this error current develop across r5=10 k a error voltage of about 1.6 mV.

In order to quantify the type of improvement that is possible using the circuitry and methodology of the present invention, a circuit according to FIG. 2 was designed and simulated. In this exemplary simulated circuit, the resistors values are: r1=30 k; r2=5 k; r3=r4=r8=190 k; r7=142 k. Q1, Q3, Q5, Q6, Q7, Q8 are unity area bipolar transistors; Q2 and Q4 are each on an area of 25 parallel unity area bipolar transistors. From the area point of view the two circuits (FIG. 1 and FIG. 2) are comparable as the total number of unity bipolar transistors are close: Q2 in FIG. 1 is 50 units, Q2 and Q4 in FIG. 2 are each 25 units. The current passing r3, Q2, r1 and Q4 is a PTAT current of about 5 uA at room temperature, the same as it was for the circuit according to FIG. 1. Also, the amplifiers are the same in both circuits.

Figure 5:
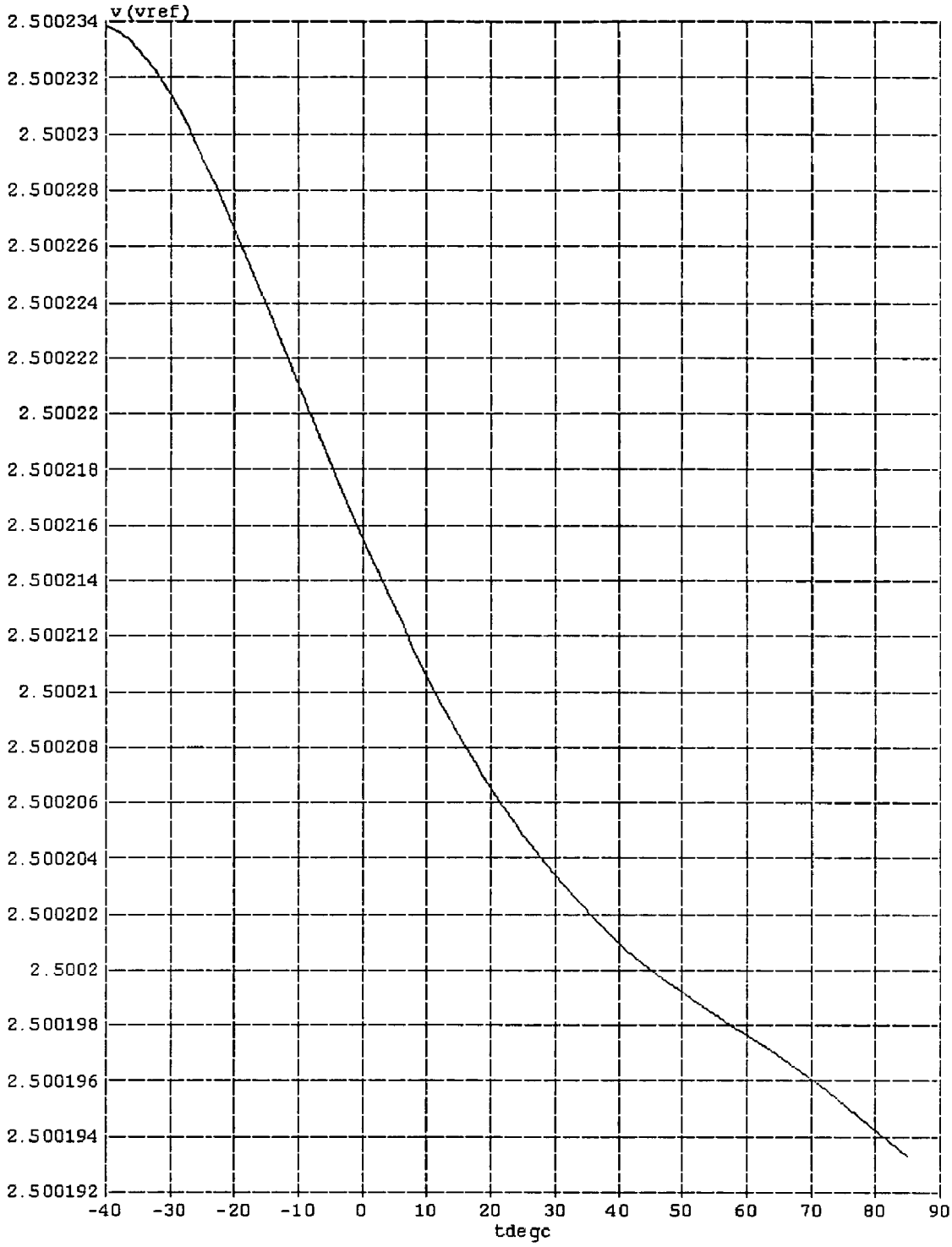
FIG. 5 is a simulation of the reference voltage in accordance with the circuit of FIG. 2.

A simulated reference voltage according to FIG. 2 is presented in FIG. 5. The total voltage variation according to FIG. 4 is about 40 uV, for the same temperature range, −40° C. to 85° C. This correspond to a TC of about 0.15 ppm/° C. and this is a reduction of TC of 10/0.15=68.

Figure 6:
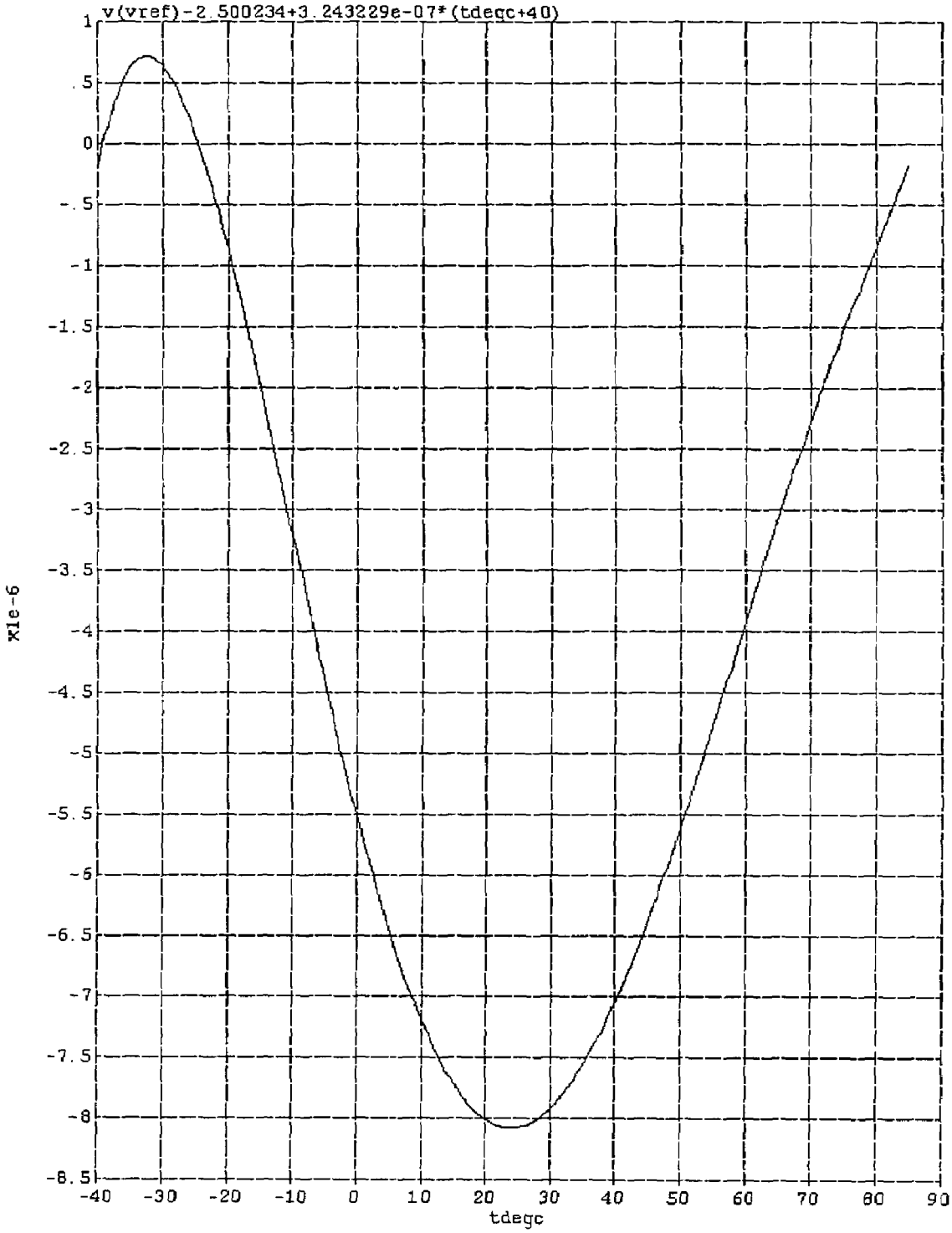
FIG. 6 is a simulation of the base current (Q1), the correction base current (Q5) and their difference in accordance with the circuit of FIG. 2.

If the slope of the voltage reference into the circuit of FIG. 2 is compensated by fine tuning remains only the residual voltage curvature and this is displayed in FIG. 6. As FIG. 5 shows the residual "curvature" voltage corresponds to a TC of about 0.025 ppm/° C.

Figure 7:
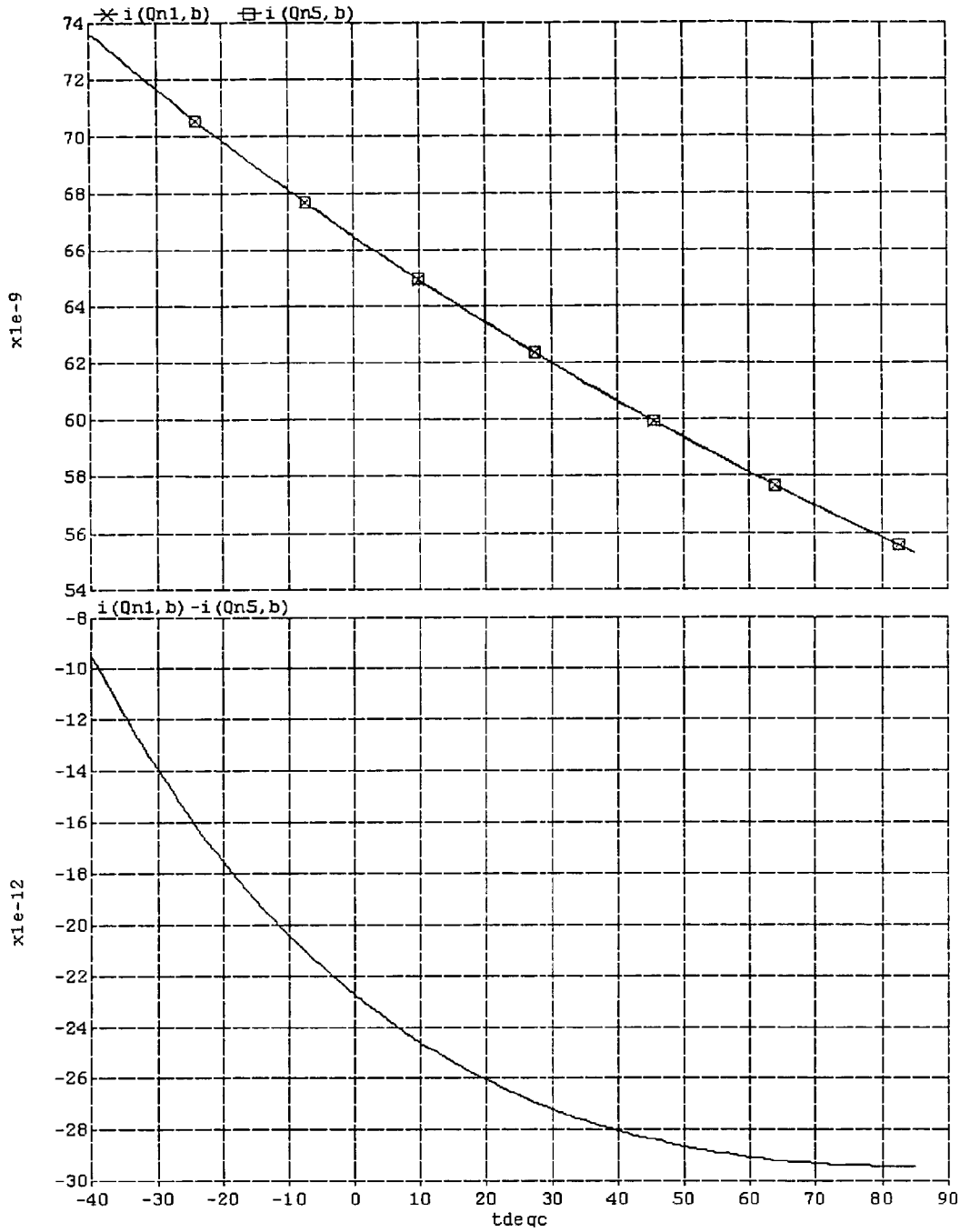
FIG. 7 is a simulation of the base current, the compensation base current and their difference for the circuit of FIG. 2.

FIG. 7 shows how the base currents of Q1 and Q5 track each other. As we can see these currents are about 63 nA at room temperature and their difference is less than 30 pA for the entire temperature range. The voltage drop of this current across r4 in FIG. 2 is less than 6 uV compared to 1.6 mV voltage error due to the base current into the circuit of FIG. 1.

The amplifier input offset voltage influence into the reference voltage was simulated for both circuits. For the circuit according to FIG. 1, 1 mV offset voltage into the amplifier's input is reflected as 1.88 mV error into the reference voltage. For the circuit according to FIG. 2, a 1 mV offset voltage is reflected as 0.57 mV. This corresponds to a reduction of more than three times in offset and noise sensitivity from the circuit of FIG. 1 to the circuit of FIG. 2.

Figure 8:
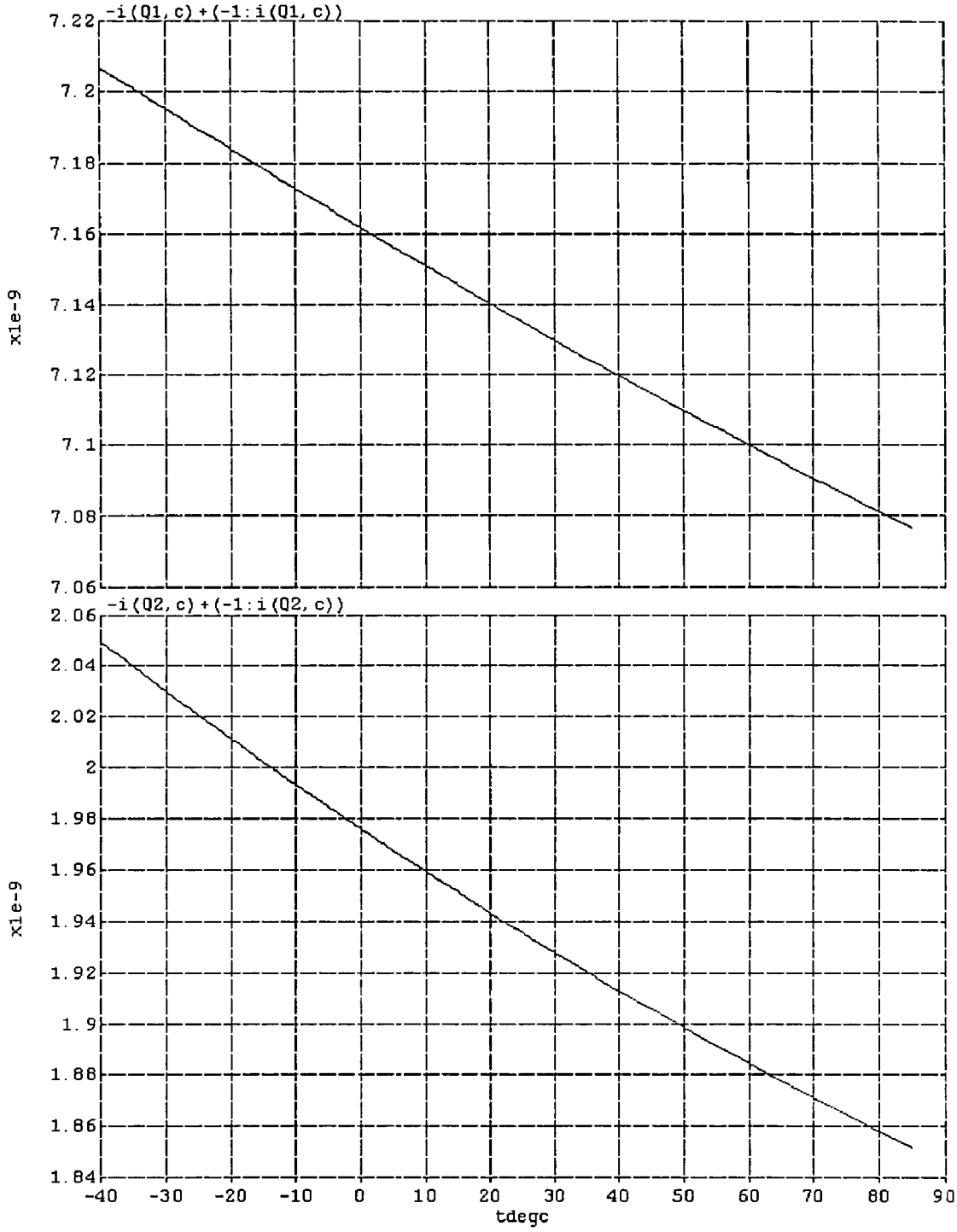
FIG. 8 highlights how the offset voltage influence the collector currents of Q1 and Q2 into the circuit of FIG. 2.

FIG. 8 highlights how the offset voltage influence the collector currents of Q1 and Q2 into the circuit of FIG. 2. The first diagram shows the alteration of the collector currents of Q1 and Q3 due to a offset voltage of 1 mV. The lower diagram shows the alteration of collector currents of Q2 and Q4 for the same offset voltage. As it seen the offset voltage is reflected mainly into the high density current side (Q1 and Q3) and this is due to the inherent feedback against offset voltage which was mentioned before.

The offset voltage of the second amplifier A2 in FIG. 2 has very low influence into the reference voltage. 1 mV offset voltage for A2 translates as an error of les than 30 uV into the reference voltage of the circuit according to FIG. 2.

Figure 9:
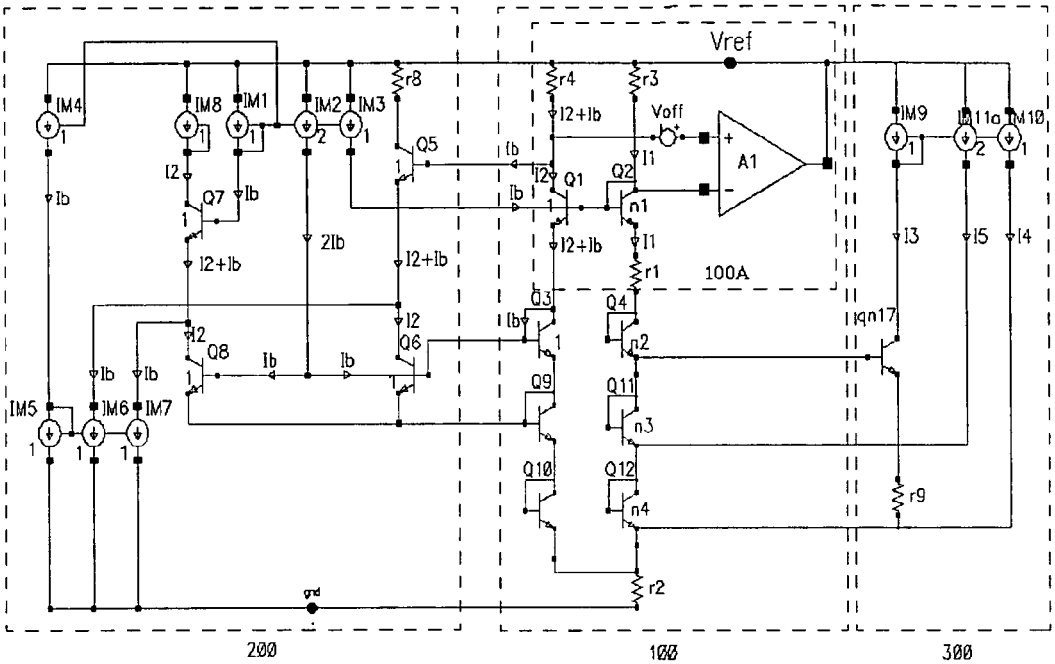
FIG. 9 is modification to the circuit of claim 1 including additional transistors provided in a stack arrangement.

The reference voltage according to FIG. 2 can be adapted for a higher reference voltage value by stacking more bipolar transistors. One such example aimed to generate a 5V reference voltage is presented in FIG. 9. FIG. 9 is very similar to that of FIG. 2 with the only difference being the addition of components to the main reference block 100 and the subsequent changing of the coupling arrangement between the main reference block 100 and the other two blocks 200, 300.

In FIG. 9 additional transistors Q9, Q10, Q11 and Q12 are provided in a stack arrangement coupled to the transistors Q3 and Q4. All four of the new transistors are provided in a diode connection configuration with the collector of Q9 being coupled to the emitter of Q3, the collector of Q10 being coupled to the emitter of Q9. Similarly, the collector of Q11 is coupled to the emitter of Q4, the collector of Q12 being coupled to the emitter of Q10. Q11 and Q12 are provided between the resistor r2 and the transistor Q4. The coupling of the first block 100 to the third block 300 is provided through the common node of Q11 and Q12, and Q12 and r2. In a similar fashion, the coupling of the block 100 to the block 200 is effected through connections coupled to the common node of Q10, Q12 and r2. The effect of the stacking of the transistors is to enable operation of the circuit at higher voltages as will be appreciated by those skilled in the art. As such the number of transistors shown is for exemplary purposes only and any number of stacked transistors of varying properties could equivalently be used.

FIG. 9 also shows an alternative way in which the curvature can be corrected. In this embodiment, the amplifier and MOSFET arrangement that was present in the equivalent block 300 of FIG. 2 is replaced by a transistor qn17 and resistor r9 arrangement. The base of qn17 is coupled to the emitter of Q4, the collector to current source IM9 and the emitter to resistor r9. The second terminal of r9 is coupled to the emitter of Q12. The curvature correction is provided in a similar fashion to that described earlier. The base-emitter voltage of Q4 is coupled via Q12 across resistor, r9, and a CTAT current is generated using current mirrors IM9 and IM11. The CTAT current is fed back into the diode-connected transistor Q11 in order to exaggerate its curvature and thereby replicating across r1 a negative voltage "curvature". This arrangement is possible due to the greater number of stacked transistors available in the embodiment of FIG. 9 and it will be appreciated that any number of different schema may be used to provide the block functionality of the curvature correction block 300, and that although two exemplary embodiments have been illustrated in FIGS. 9 and 2, that these are illustrative of the type that may be used with the other blocks of the present invention and as such modifications may be made without departing from the spirit and scope of the present invention.

Figure 10:
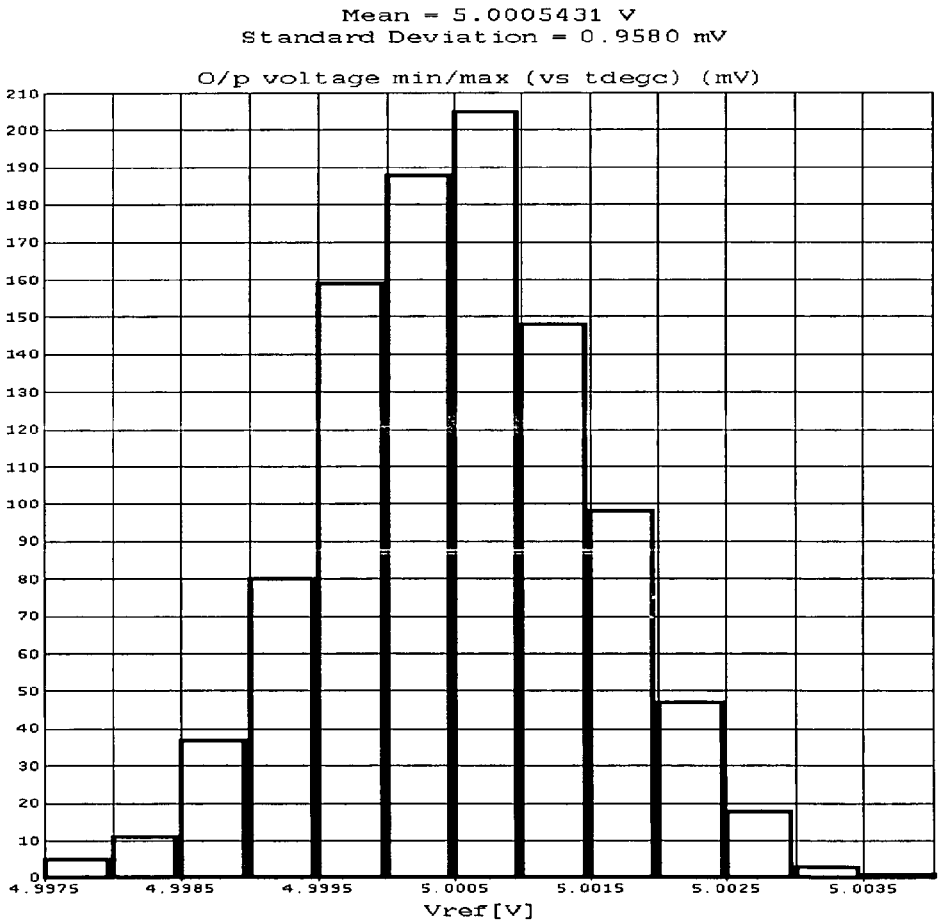
FIG. 10 is a simulation of the performance of the circuit of FIG. 9.

A circuit according to FIG. 9 was simulated, the simulation results being shown in FIG. 10 For this circuit the resistors values are: r1=30 k, r2=5 k, r3=r4=r8=200 k, r7=60 k; the bipolar transistors Q1, Q3, Q5, Q7, Q8, Q9, Q10 are unity emitter area of 5 u×5 u each; the bipolar transistors Q2, Q4, Q11 and Q12 are each an area of 12 unity emitter area of 5 u×5 u. A MONTE CARLO analysis of 1000 iteration at 25° C. temperature were perform for the circuit according to FIG. 9 to see the reference voltage spread due to process variation. As FIG. 10 shows, the parameter "σ" in the distribution is 1.25 mV in 5V reference voltage. For 3σ, the deviation in reference voltage is about 0.075%.

The bandgap voltage reference in accordance with the circuit of the present invention is also advantageous in generates the inherently PTAT and CTAT currents required if extra trimming is to be performed.

It will be understood that the present invention has been described with reference to specific NPN configurations of bipolar transistors and that it is not intended that the application of the invention be limited to such configurations. As will be understood by the person skilled in the art many modifications and variations in configurations may be achieved by implementation in PNP architectures or the like. It will be appreciated that what has been described herein is an exemplary embodiment of a bandgap voltage reference in accordance with the present invention. Specific components, features and values have been used to describe the circuit in detail, but it is not intended that the present invention be limited in any way whatsoever except as may be deemed necessary in the light of the appended claims. It will be further appreciated that some of the components of the present invention have been described using their conventional symbols and the actual functional description of how for example an amplifier is constructed has been omitted. Such functionality will be well known to the person skilled in the art and where additional details is required, it will be understood that it can be found in any number of standard text books.

Similarly, the words comprises/comprising when used in this specification are to specify the presence of stated features, integers, steps or components but does not preclude the presence or addition of one or more other features, integers, steps, components or groups thereof.

The invention claimed is:

1. A bandgap reference voltage circuit configured to reduce the Early effect, the circuit including a first amplifier having first and second inputs and providing a buffered voltage reference at the output thereof, the amplifier being coupled at its first input to a first bipolar transistor and at the second input to a second bipolar transistor, the second transistor having an emitter area larger than that of the first transistor, and wherein:

the second transistor is coupled at its emitter to a load resistor, the load resistor providing, in use, a measure of the difference in base emitter voltages between the first and second transistors, ΔVbe, for use in the formation of the bandgap reference voltage, the bases of each transistor are commonly coupled such that the base of the first and second transistor is at the same potential, one of the first and second transistors is provided in a diode connected configuration, and the base collector voltage of the other of the first and second transistors is maintained at zero by the amplifier which is coupled in a feedback loop to the collector of each of the transistors, and the circuit further includes a third transistor and a fourth transistor, the third transistor being coupled to the emitter of the first transistor and the fourth transistor being coupled via the load resistor to the emitter of the second transistor, the emitter area of the fourth transistor being greater than that of the first or third transistor, such that the first and third transistors operate at a higher current density than the second and fourth transistors and wherein a PTAT voltage is provided via a resistor, in the feedback loop, at the second input to the amplifier such that the voltage provided at the output of the amplifier is a combination of the base-emitter voltages of the first and third transistors plus the PTAT voltage.

2. The circuit as claimed in claim 1 wherein each of the third and fourth transistors are provided in a diode connected configuration.

3. The circuit as claimed in claim 1 wherein the emitter of the third transistor is coupled via a second resistor to ground, the value of the resistor effecting a shifting of the reference voltage from twice the natural bandgap voltage to a desired voltage, thereby enabling an offset adjustment to the circuit.

4. The circuit as claimed in claim 2 further including a third and fourth resistor provided in each of the feedback loop paths between the output of the amplifier and the collectors of the first and second transistors respectively.

5. The circuit as claimed in claim 4 wherein the resistors provided in each of the feedback loops are substantially the same value.

6. The circuit as claimed in claim 4 wherein the resistors provided in each of the feedback loops are of different values.

7. The circuit as claimed in claim 4 further including circuitry adapted to provide the base current for the non-diode connected transistor and to extract that same current from the collector of the same transistor, thereby maintaining the collector current of each of the first and second transistors at the same value.

8. The circuit as claimed in claim 4 further including circuitry adapted to provide the base current for the non-diode connected transistor and to extract that same current from the collector of the same transistor, the circuitry adapted to compensate for base current variation between the non-diode connected transistor and the other transistor, thereby reducing errors in the circuit due to the base current of bipolar transistors.

9. The circuit as claimed in claim 7 wherein the non-diode connected transistor is the first transistor and the circuitry adapted to extract the current from the collector of the first transistor includes a replication of the leg of the circuit defined by the first and third transistors, the replicated leg including a fifth and sixth transistor of the circuit, the base of the fifth transistor being coupled to the collector of the first transistor, the emitter of the fifth transistor being coupled to the collector of the sixth transistor, the base of the sixth transistor being coupled to the diode connected base of the third transistor thereby providing a current mirror, such that a base current is extracted from the collector of the first transistor by the fifth transistor.

10. The circuit as claimed in claim 9 wherein the base current of the first and second transistors is further mirrored via seventh and eight transistors and a current mirror, the base currents of the sixth and eight transistors being supplied by a double current mirror from the output of the amplifier and the base current of the first and second transistors being supplied by another double current mirror such that the collector currents of each of the first, second, third, sixth and eight transistors are the same.

11. The circuit as claimed in claim 10 wherein the collector of the fifth transistor is coupled via a resistor to the output of the amplifier, the value of the resistor being substantially equivalent to that of the fourth resistor such that the base current of the fifth transistor tracks the base current of the first transistor.

12. The circuit as claimed in claim 10 wherein the base current of the first and second transistors is further mirrored via a series of mirrors coupled to the fifth and seventh transistors such that the mirrored current may be extracted from the emitters of the fifth and seventh transistors thereby ensuring that the collector currents of the fifth and seventh transistors are substantially the same value, this current being further mirrored via a current mirror coupled between the collector of the seventh transistor and the output of the amplifier, thereby providing a PTAT current.

13. The circuit as claimed in claim 2 further including circuitry adapted to provide a correction voltage adapted to compensate for the curvature of the voltage of the first and third transistors, the incorporation of the correction voltage effecting a cancelling of the curvature.

14. The circuit as claimed in claim 13 wherein the circuitry adapted to provide a correction voltage is adapted to provide a mixture of PTAT and CTAT current into the fourth transistor.

15. The circuit as claimed in claim 13 wherein the correction voltage is provided by mirroring the base-emitter voltage of the fourth transistor across a resistor and effecting the generation of a complimentary to absolute temperature (CTAT) current using current mirrors and amplifier, the CTAT current being provided back into the fourth transistor via at least one current mirror thereby replicating across the first resistor a voltage having an inverse curvature, the combination of this replicated voltage and the previously present voltage ($\Delta V_{be}$) effecting a cancellation of the curvature.

16. The circuit as claimed in claim 14 wherein the size of the voltage having an inverse curvature may be modified by changing the slope of the current provided by the current mirror and fourth transistor.

17. The circuit as claimed in claim 1 further including a plurality of additional transistors coupled to the third and fourth transistors, the plurality of additional transistors being provided in a stack arrangement, thereby enabling a use of the reference circuit with higher reference voltages.

18. A bandgap reference voltage circuit configured to reduce the Early effect, the circuit including a first amplifier having first and second inputs and providing a voltage reference at the output thereof, the amplifier being coupled at its first input to a first transistor and at the second input to a second transistor, the amplifier being coupled in a feedback loop to the collector of each of the transistors, the second transistor having an emitter area larger than that of the first transistor, the circuit additionally including a third and fourth transistor, each being provided in a diode connected configuration, and wherein:

the second transistor is coupled at its emitter to a load resistor, the load resistor providing, in use, a measure of the difference in base emitter voltages between the first and second transistors, ΔVbe, for use in the formation of the bandgap reference voltage, the bases of each transistor are commonly coupled such that the base of the first and second transistor is at the same potential, one of the first and second transistors is provided in a diode connected configuration, the third transistor is coupled to the emitter of the first transistor and the fourth transistor is coupled via the load resistor to the emitter of the second transistor, the emitter area of the fourth transistor being greater than that of the first or third transistor, such that the first and third transistors operate at a higher current density than the second and fourth transistors and wherein a PTAT voltage is provided via a resistor, in a feedback loop of the amplifier, at the second input to the amplifier such that the voltage provided at the output of the amplifier is a combination of the base emitter voltages of the first and third transistors plus the PTAT voltage, and the base-collector voltage of the other of the first and second transistors is minimized by the amplifier which is coupled in a feedback loop to the collector of each of the transistors.

19. A method of providing a bandgap reference voltage circuit configured to compensate for the Early effect, the method comprising the acts of:

providing first and second transistors, each transistor adapted to operate at different current densities, the first transistor being provided in a diode connected configuration, the transistors being additionally coupled to the inputs of an amplifier, providing third and fourth transistors, the third transistor being coupled to the emitter of the first transistor and the fourth transistor being coupled via a load resistor to the emitter of the second transistor, the emitter area of the fourth transistor being greater than that of the first or third transistor, such that the first and third transistors operate at a higher current density than the second and forth transistors.

scaling the voltage difference between two transistors operating at different current densities so as to provide a reference voltage at an output of the amplifier, and providing a feedback loop, the feedback loop coupling each of the first and second transistors to the output of the amplifier so as to provide at an output of an amplifier a buffered voltage reference, such that the collector base voltage of each of the first and second transistors is reduced to zero, and further wherein a PTAT voltage is provided via a resistor, in the feedback loop, at the second input to the amplifier such that the voltage provided at the output of the amplifier is a combination of the base emitter voltages of the first and third transistors plus the PTAT voltage.

* * * * *